US007216520B1

(12) United States Patent
Villanueva

(10) Patent No.: US 7,216,520 B1
(45) Date of Patent: May 15, 2007

(54) CROSS-THREADING PREVENTION APPARATUS FOR INSTALLING NUT INSERTS

(75) Inventor: Ramon C. Villanueva, Palmdale, CA (US)

(73) Assignee: AVK Industrial Products, Valencia, CA (US)

( * ) Notice: Subject to any disclaimer, the term of this patent is extended or adjusted under 35 U.S.C. 154(b) by 0 days.

(21) Appl. No.: 11/504,258

(22) Filed: Aug. 14, 2006

(51) Int. Cl.
*B21J 15/12* (2006.01)

(52) U.S. Cl. ..... 72/114; 72/391.8; 29/243.526

(58) Field of Classification Search ..... 72/114, 72/391.4, 391.8; 29/243.518, 243.524, 243.525, 29/243.526
See application file for complete search history.

(56) References Cited

U.S. PATENT DOCUMENTS

| | | | | |
|---|---|---|---|---|
| 2,753,072 | A * | 7/1956 | Mitchell | 72/391.8 |
| 3,654,792 | A * | 4/1972 | Mead | 72/391.8 |
| 3,686,915 | A | 8/1972 | Miller et al. | |
| 3,838,588 | A * | 10/1974 | Johnson | 72/114 |
| 4,070,889 | A | 1/1978 | DeCaro | |
| 4,229,960 | A * | 10/1980 | Nilsson | 72/391.8 |
| 4,321,814 | A | 3/1982 | Martin | |
| 4,368,631 | A | 1/1983 | Tanikawa | |
| 4,571,976 | A | 2/1986 | Schwab | |
| 4,574,612 | A | 3/1986 | Tanikawa | |
| 4,612,793 | A | 9/1986 | Klein | |
| 5,605,070 | A | 2/1997 | Wille | |
| 6,272,899 | B1 | 8/2001 | Bentivogli | |
| 6,328,515 | B1 | 12/2001 | Donovan | |
| 6,558,096 | B2 | 5/2003 | Kelch | |
| 6,840,075 | B2 * | 1/2005 | Neri et al. | 72/114 |
| 6,962,068 | B2 | 11/2005 | Villanueva | |

* cited by examiner

*Primary Examiner*—David Jones
(74) *Attorney, Agent, or Firm*—James M. Duncan; Klein, DeNatale, Goldner

(57) ABSTRACT

An insert installation apparatus comprises a housing having a body section and a nose piece. The nosepiece comprises a forward end and a rearward end, where the rearward end of the nose piece is attached to the body section. The apparatus comprises a rotary power source and reciprocating means which are employed to set a threaded insert in a work piece. The rotary power source has an extension member which connects the rotary power source to the first end of a drive shaft which is received by the extension member. The second end of the drive shaft is operationally coupled to a partially threaded mandrel which extends out of the forward end of the nose piece. The apparatus further comprises mandrel shock absorbing means which allow the mandrel to reciprocate with respect to the nose piece from a first position to a second position, where the mandrel shock absorbing means operates independently from the reciprocating means which usually employed to set the threaded insert. The mandrel shock absorbing means allows the threaded shaft to "give" if the tip of the mandrel impacts the crests of the threads of the insert as the tip is inserted into the opening of the insert. While a small spring or other biasing means are used to bias the threaded shaft forward the threaded shaft may be partially pushed back into the nose piece upon contact with the threads of the insert, thus preventing impact damage to the root thread of the insert and preventing cross-threading.

20 Claims, 5 Drawing Sheets

CROSS-THREADING PREVENTION APPARATUS FOR INSTALLING NUT INSERTS

BACKGROUND OF THE INVENTION

The present invention relates to an apparatus for installing nut inserts to a workpiece, the workpiece having a first side and a second. Usually the first side is a visible side and the second side is a blind side, meaning there is no access to the second side. More particularly, this invention relates to a modified installation tool which reduces incidents of cross-threading of the nut insert and/or damage to the installation tool.

It is known to use threaded rivet nuts, threaded inserts, and threadable inserts (generally, "anchor devices") as anchors for threaded fasteners in a number of different applications, including thin wall applications, such as sheet metal, which may be too thin to be tapped with threads. In many such cases there is access only to one side of the workpiece. In general, the workpiece is drilled or punched and the anchor device is placed within the resulting hole. The anchor device is either threaded onto a threaded mandrel of the installation tool and placed within the hole by the installation tool, or the threaded mandrel is made up onto the threads of the anchor device after the anchor device has been placed in the hole. When the installation tool is activated, a portion of the anchor device on the blind side of the workpiece, such as a sleeve portion, is deformed to create an enlargement or bubble which prevents removal of the insert from the hole. After the installation tool is removed, a threaded fastener may be inserted into a threaded portion of the insert.

Installation tools for setting nut inserts, particularly in blind applications, are generally known. These tools generally comprise a tool body from which extends a mandrel having external threads. The mandrel typically extends through a nose piece which is connected to the front of the tool body. Rotational means are operationally connected to the rear of the mandrel for rotating the threaded mandrel to make up the threaded mandrel within the nut insert prior to deformation of the sleeve portion. The threads of the mandrel are made up into the threads of the nut insert until a flange on the end of the insert abuts the front end surface of the nose piece. If not already placed within an aperture of the work piece, the insert is thereafter placed within the aperture until the flange abuts the first side of the workpiece.

A linear force is applied to the mandrel by partially pulling the mandrel into the tool body with reciprocation means. The linear force applied to the insert causes the sleeve of the insert to plastically deform, such that the resulting enlargement or bubble is larger than the diameter of the aperture, preventing withdrawal of the insert from the aperture. Examples of such tools may be found in U.S. Pat. Nos. 4,070,889; 4,368,631; 4,612,793; 4,574,612; 5,605,070; and 6,272,899.

On occasion, the threads of the insert are cross-threaded as the male threaded mandrel is inserted into the female threaded insert. Cross-threading can occur with a threaded insert when the threaded mandrel is engaged with the female insert and the threads are not properly aligned when the threads of the mandrel and the threads of the insert first engage. If the threads of the mandrel and the threads of the insert are not properly aligned at the start, the external thread tends to cross over the crest of the internal thread which can produce deformation of the threads and can also cause binding of the mandrel and insert before the desired makeup of the mandrel into the insert is achieved. Unless the mandrel and nut insert are manually realigned at this point, the external thread will wedge against the internal thread and prevent the proper makeup of the mandrel into the nut insert and/or cause damage to the threads of either the insert or the mandrel.

It has been found by the inventor herein that in addition to improper alignment, another cause of cross-threading is that the threads of the insert adjacent to the opening, including the root thread, can be damaged by the tip of the mandrel as the mandrel is inserted into the opening of the insert by the operator or operating machinery. The tip of the mandrel may impact the crests of the threads of the insert as the tip is inserted into the opening of the insert. With the existing installation tools, there is little give by the mandrel, such that the resulting impact load is absorbed almost entirely by the threads of the insert.

SUMMARY OF THE INVENTION

The present invention is directed to an improved installation tool which meet the needs identified above. The improved insert installation apparatus comprises a housing having a body section and a nose piece. The nosepiece comprises a forward end and a rearward end, where the rearward end of the nose piece is attached to the body section.

A rotary power source and reciprocating means are contained within the housing. The rotary power source has an extension member which connects the rotary power source to the first end of a drive shaft which is received by the extension member.

The improved insert installation apparatus further comprises a mandrel. The mandrel is connected on one end, referred to herein as the "drive end", to a drive shaft which connects the mandrel to the rotary power source. The drive shaft further comprises a circumferential shoulder member. The opposing end of the mandrel is a threaded shaft which extends out the forward end of the nose piece.

The apparatus further comprises mandrel shock absorbing means which allow the mandrel to reciprocate with respect to the nose piece from a first position to a second position, where the mandrel shock absorbing means operates independently from the reciprocating means which are employed to apply the linear force to the threaded insert. The mandrel shock absorbing means allows the threaded shaft to "give" if the tip of the mandrel impacts the crests of the threads of the insert as the tip is inserted into the opening of the insert. It is to be appreciated that one embodiment of the reciprocating means utilizes the application of hydraulic pressure to a piston inside the housing, where a large spring or springs bias the piston (and thus the threaded shaft) forward. In the known tools of this type, there is little or no axial "give" in the threaded shaft because of the strength of the biasing means pushing forward on the piston. That is, with the known tools of this type, the threaded shaft is not easily pushed into the tool body. Thus, the tip of the shaft has little give and is capable of imposing a hard impact on the threads of an insert. However, the mandrel shock absorbing means of the present invention allow the mandrel to be pushed a small amount, approximately 0.7 inch, into the tool body. While a small spring or other biasing means are used to bias the threaded shaft forward (i.e. extending outside of the tool), the threaded shaft may be partially pushed back into the nose piece upon contact with the threads of the insert, thus preventing impact damage to the root thread of the insert and preventing cross-threading. The shaft may further comprise a tip which assists in proper alignment of the threaded mandrel with the threads of the insert. For example, the tip may be chamfered or rounded.

These and other features, aspects, and advantages of the present invention will become better understood with regard to the following description, appended claims, and accompanying drawings.

DETAILED DESCRIPTION OF THE EMBODIMENTS

Figure 1:
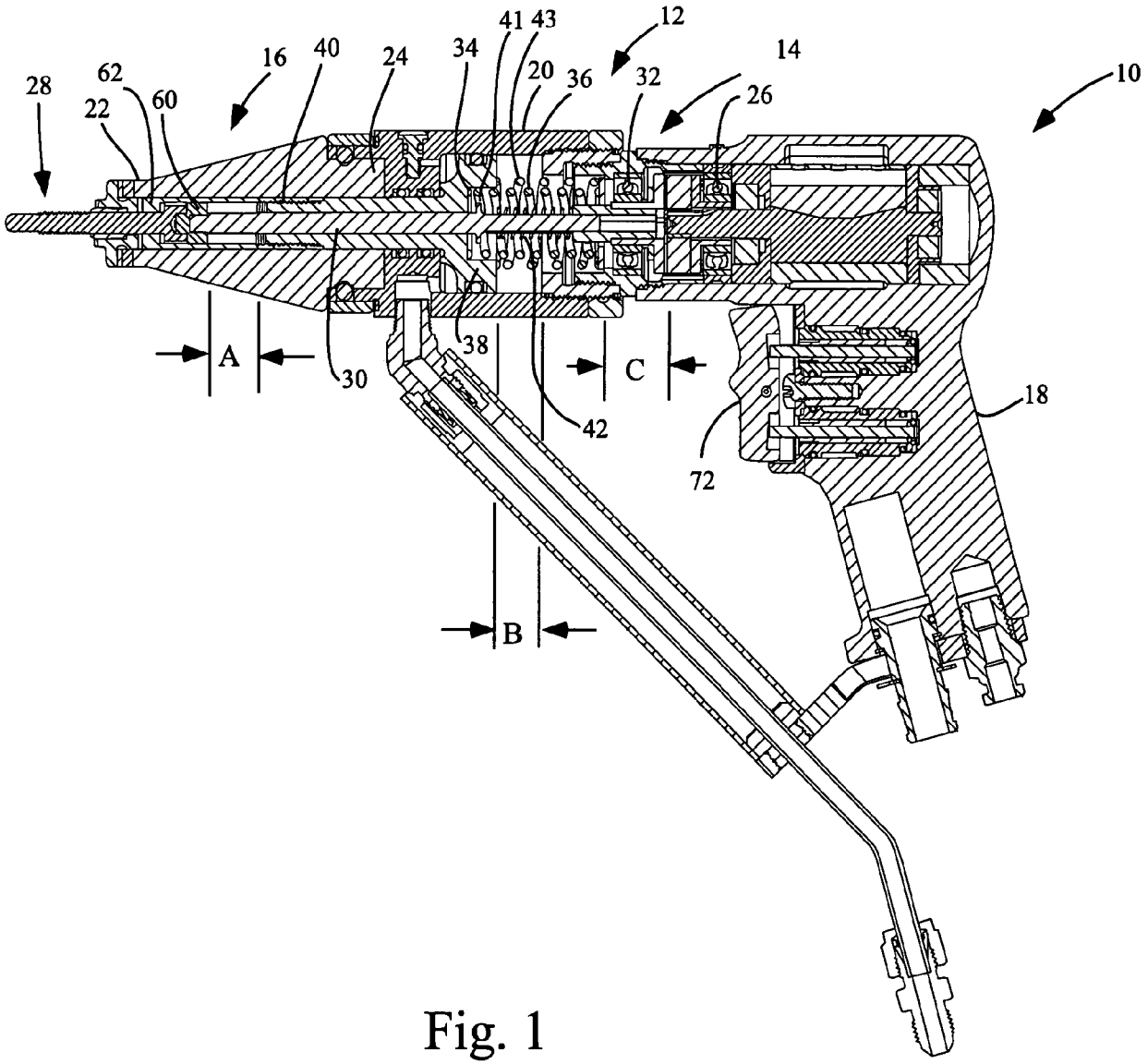
FIG. 1 shows an internal view of an installation tool comprising the improvements disclosed herein.

Referring now specifically to the drawings, FIG. 1 shows a cross-section of an embodiment of the threaded insert installation apparatus. The apparatus 10 comprises a housing 12 which may, as shown in FIG. 1, be configured in a pistol form, or in other configurations such as a straight housing. The housing 12 may comprise a body section 14 and a nose piece 16. The body section 14 may comprise a handle section 18 and an intermediate section 20. The nose piece 16 may comprise a forward end 22 and a rearward end 24. As shown in FIG. 1, rearward end 24 of the nose piece 16 is attached to the body section 14.

A rotary power source, such as a pneumatic motor 26, is contained within housing 12. The rotary power source provides rotary motion to mandrel 28, which is connected to the rotary power source by drive shaft 30. An extension member 32 couples the drive shaft 30 to the rotary power source. In addition to rotational motion, mandrel 28 is also configured to be stroked in a reciprocating motion by reciprocating means operationally attached to the mandrel, such as piston assembly 34. Piston assembly 34 may be biased in a forward position, that is, biased toward the front of the apparatus 10 (i.e. toward the nose piece 16) by spring 36. As shown in greater detail in FIGS. 13–16, piston assembly 34 may comprise a piston body 38 and piston shaft 40. The piston assembly 34 may be reciprocated to a rearward position, that is, axially away from the nose piece 16, by the application of a force, such as hydraulic force, sufficient to overcome the bias of spring 36 or other biasing means. When reciprocated rearward, piston shaft 40 pulls mandrel 28 rearward as well because piston shaft 40 is connected to cover member 62, and the end plate 68 of the cover member engages the drive end 48 of the mandrel, thus pulling the mandrel and drive shaft 30 rearward.

Drive shaft 30 is free to float with respect to extension member 32, that is, the end of the drive shaft inserted in the extension member is, subject to the biasing means described below, free to move axially within the extension member over the length C indicated in FIG. 1. For example, the inventor herein has found that if length C is approximately 0.75 inches, there is sufficient length for the adequate stroke of drive shaft 30 to allow for the operation of the reciprocating means and for the operation of the mandrel shock absorbing means. Drive shaft 30 is biased in a forward position, that is, biased toward the front of the apparatus 10 by biasing means, such as spring 42, such that mandrel 28, which is operationally attached to drive shaft 30, is also biased forward.

The length B denotes the stroke length of piston assembly 34. The stroke length is the amount the piston assembly 34 moves in an axial direction when the reciprocation means is activated. The inventor herein has found that a stroke length B of 0.50 inches is sufficient stroke length to collapse the sleeve of an insert as discussed below.

It is to be appreciated that if mandrel 28 impacts against an object, such as the root thread of a fastener, the mandrel shock absorbing means of the apparatus allow the mandrel to be depressed into the nose piece 16 if the force applied by the biasing means is exceeded. The biasing means, such as spring 42, will typically be sized to require a very small load to depress the mandrel. As shown in FIG. 1, mandrel 28 may be depressed a length A into the nose piece without engaging the front of piston shaft 40. The inventor herein has found that a suitable dimension for length A, that is the stroke length of the mandrel shock absorbing means, is approximately 0.70 inches. As mandrel 28 is depressed into the nose piece 16, drive shaft 30 cooperatively moves in a rearward direction into the extension member 32. However, reciprocation of the mandrel 28 and the drive shaft 30 into the housing 12 does not require a simultaneous reciprocation of the piston assembly 34 unless the mandrel is depressed more than length A. In other words, the mandrel shock absorbing means operates independently of the reciprocation means for the stroke length of the mandrel shock absorbing means.

Figure 2:
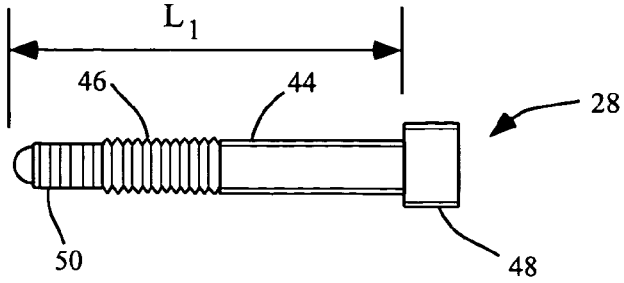
FIG. 2 is a side view of a mandrel which may be utilized in an embodiment of the disclosed invention.

FIG. 2 shows an embodiment of a mandrel 28 which may be utilized in an embodiment of the disclosed apparatus. Mandrel 28 comprises a shaft 44. The mandrel 28 further comprises threads 46 and a drive end 48. The drive end 48 is operably coupled to one end of the drive shaft 30 either directly or by means of coupling member 60. As shown in FIG. 1, a portion of mandrel 28 is disposed in nose piece 16 such that the threads 46 extend beyond the forward end 22 of the nose piece. In an embodiment of the device where length A is 0.70 inches, length B is 0.50 inches, and length C is 0.75 inches, the length of $L_1$ of shaft 44 may be configured to a length of approximately 1.750 inches. Mandrel 28 may further comprise a chamfered or rounded end 50, which facilitates the insertion of the of the threads 46 into a threaded insert, such as the type of insert 52 shown in FIG. 21. As shown in FIG. 2, the tip 50 may comprise a "dog point" where a portion of the tip has, beginning at the tip, a reduced diameter which transitions into the larger thread diameter. For example, for a mandrel having a M6 size shaft 44, there may be a section of approximately 0.350 inch in length having a diameter of about 0.189 inch which transitions to the actual thread diameter of approximately 0.236 inch.

Figure 5:
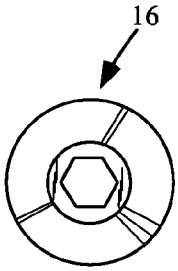
FIG. 5 is a front view of the nose piece shown in FIG. 3.
Figure 3:
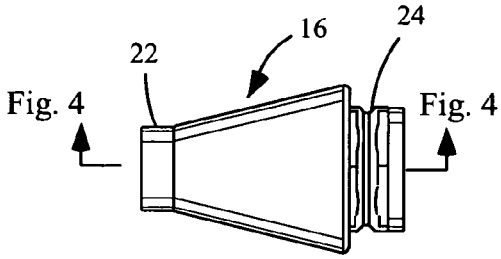
FIG. 3 is a side view of a nose piece which may be utilized in an embodiment of the disclosed invention.
Figure 6:
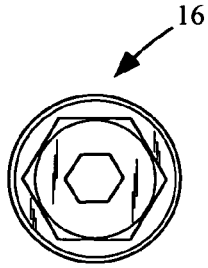
FIG. 6 is a rear view of the nose piece shown in FIG. 3.
Figure 4:
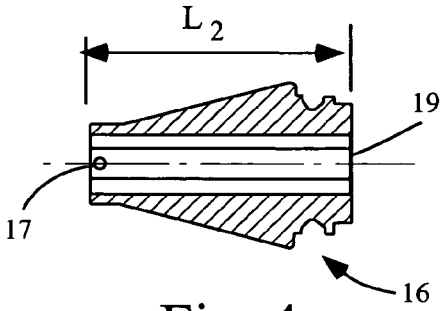
FIG. 4 is a sectional view of the nose piece shown in FIG. 3.

FIGS. 3 through 6 show an embodiment of a nose piece 16 which may be utilized in an embodiment of the disclosed invention. The nose piece comprises a forward end 22 and a rearward end 24. As shown in FIG. 1, nose piece 16 may further comprise a front member 54 which retains the mandrel 28 within the nose piece. Front member 54 may be retained within nose piece 16 by insertion of a pin through aperture 17. As shown in FIG. 4, nose piece 16 has an opening 19 extending axially through which mandrel 28 operates. As shown in FIGS. 5 through 6, the opening may be in a hexagonal configuration. In an embodiment of the device where length A is 0.70 inches, length B is 0.50 inches, and length C is 0.75 inches, the length of $L_2$ of nose piece 16 may be configured to a length of approximately 2.92 inches.

Figure 8:
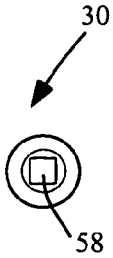
FIG. 8 is a front view of the drive shaft shown in FIG. 7.
Figure 7:
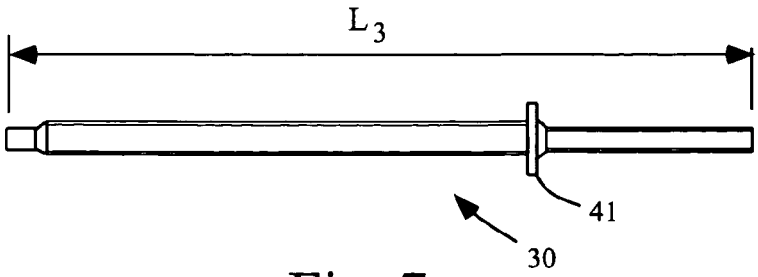
FIG. 7 is a side view of a drive shaft which may be utilized in an embodiment of the disclosed invention.
Figure 9:
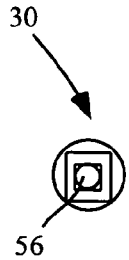
FIG. 9 is a rear view of the drive shaft shown in FIG. 7.

FIGS. 7 through 9 show an embodiment of a drive shaft 30 which may be utilized in an embodiment of the disclosed invention. As shown in FIG. 7, the drive shaft 30 comprises a circumferential shoulder member 41. Drive shaft 30 further comprises a first end 56 and a second end 58 opposite the first end. First end 56 is received by extension member 32. Second end 58 is either coupled directly to mandrel 28 or, as shown in FIG. 1, connected to coupling member 60 which in turn is connected to the mandrel. In an embodiment of the device where length A is 0.70 inches, length B is 0.50 inches, and length C is 0.75 inches, the length of $L_3$ of drive shaft 30 may be configured to a length of approximately 4.62 inches.

Figure 11:
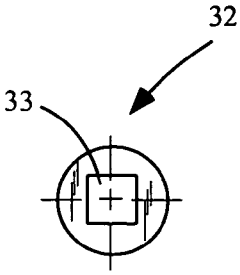
FIG. 11 is a front view of the extension member shown in FIG. 10.
Figure 10:
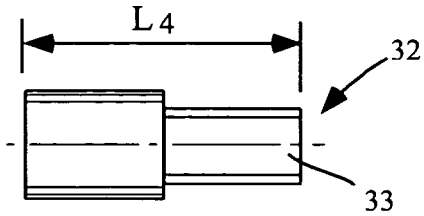
FIG. 10 is a side view of an extension member which may be utilized in an embodiment of the disclosed invention.
Figure 12:
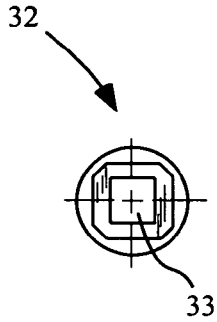
FIG. 12 is a rear view of the extension member shown in FIG. 10.
Figure 15:
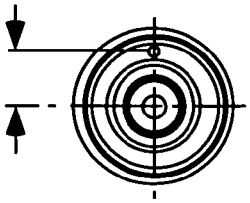
FIG. 15 is a front view of the piston shown in FIG. 13.
Figure 13:
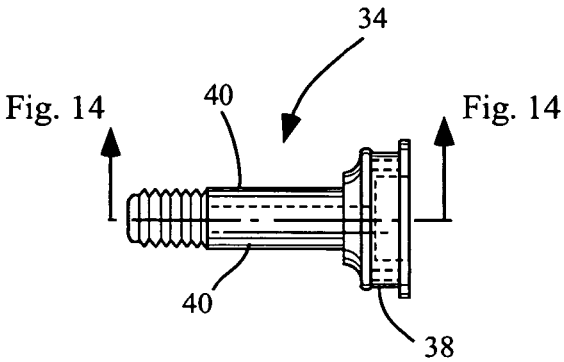
FIG. 13 is a side view of a piston which may be utilized in an embodiment of the disclosed invention.
Figure 16:
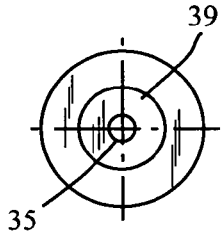
FIG. 16 is a rear view of the piston shown in FIG. 13.

FIGS. 10 through 12 shown an embodiment of an extension member 32 which may be utilized in an embodiment of the disclosed invention. Extension member 32 receives first end 56 of the drive shaft. As shown in FIG. 1, the opposite end of extension member 32 is coupled to a rotary power source, such as a pneumatic motor 26. As shown in FIG. 10, extension member 32 may have an opening 33 extending axially through the part, or alternatively may have openings on either side for receipt of the first end 56 of the drive shaft and a drive member from the rotary power source. As shown in FIGS. 11 through 12, the opening may be in a square configuration. In an embodiment of the device where length A is 0.70 inches, length B is 0.50 inches, and length C is 0.75 inches, the length of $L_4$ of extension member 32 may be configured to be a length of approximately 0.92 inches.

Figure 14:
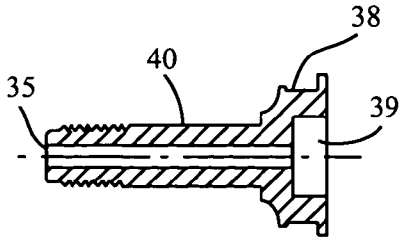
FIG. 14 is a sectional view of the piston shown in FIG. 13.

FIGS. 13 through 16 show an embodiment of a piston assembly 34 which may be utilized as reciprocating means in an embodiment of the disclosed invention. Piston assembly 34 may comprise a piston body 38 and piston shaft 40. As shown in FIG. 14, piston assembly 34 has an opening 35 extending axially through the entire assembly, through which opening drive shaft 30 may partially be disposed. Piston body 38 may have a counter-sunk opening 39 for seating of spring 36 which biases the piston assembly 34 forward. A second spring 43 may be utilized to provide additional bias to the piston assembly 34.

Figure 19:
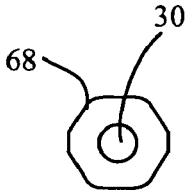
FIG. 19 is a front view of the cover member shown in FIG. 17.
Figure 17:
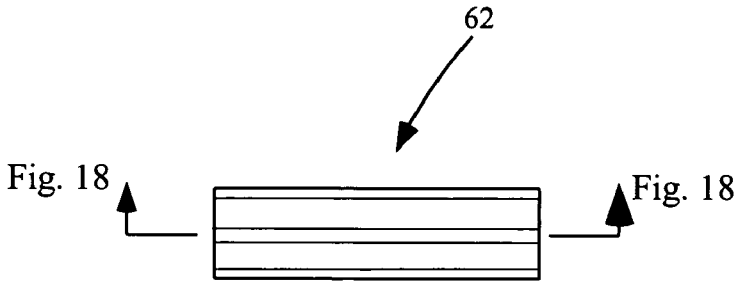
FIG. 17 is a side view of a cover member which may be utilized in an embodiment of the disclosed invention.
Figure 20:
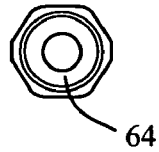
FIG. 20 is a rear view of the cover member shown in FIG. 17.
Figure 18:
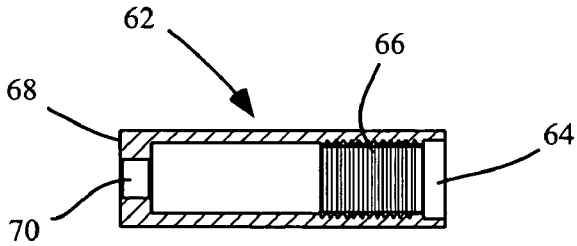
FIG. 18 is a sectional view of the cover member shown in FIG. 17.

FIGS. 17 through 20 show cover member 62. As shown in FIG. 1, cover member 62 is attached to piston shaft 40. Cover member 62 has an open end 64 which may axially attach to piston shaft 40 such as with threads 66. Cover member 62 further comprises a closed end comprising an end plate 68, the end plate having aperture 70 through which mandrel 28 operates. Aperture 70 is sized such that mandrel shaft 44 is free to reciprocate through the aperture, but drive end 48 is larger than the aperture. As shown in FIGS. 19 through 20, cover member 62 may be hexagonal in shape.

The reciprocation means and the rotary power source may be activated by trigger 72. The reciprocation means may be activated by the application of hydraulic pressure to piston assembly 34.

Figure 21:
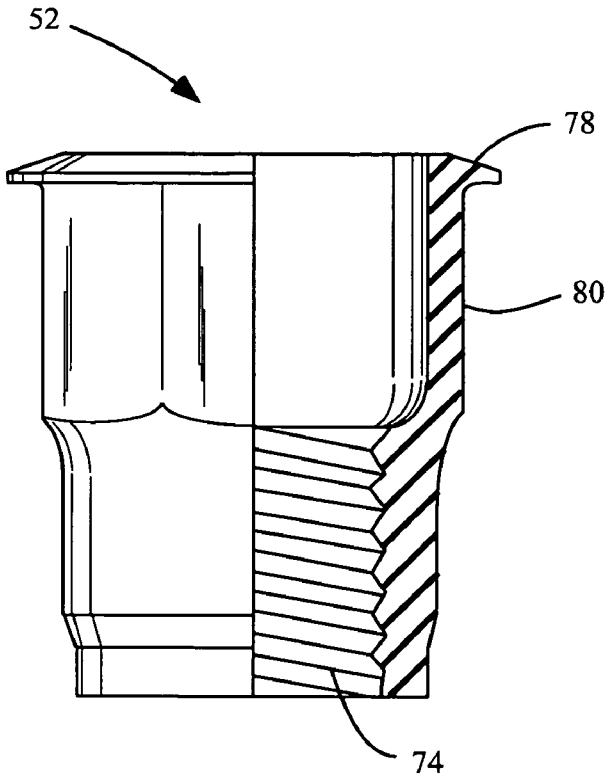
FIG. 21 shows a quarter-sectional view of a type of threaded insert which may be used with the disclosed threaded insert installation apparatus, before the insert is installed.
Figure 22:
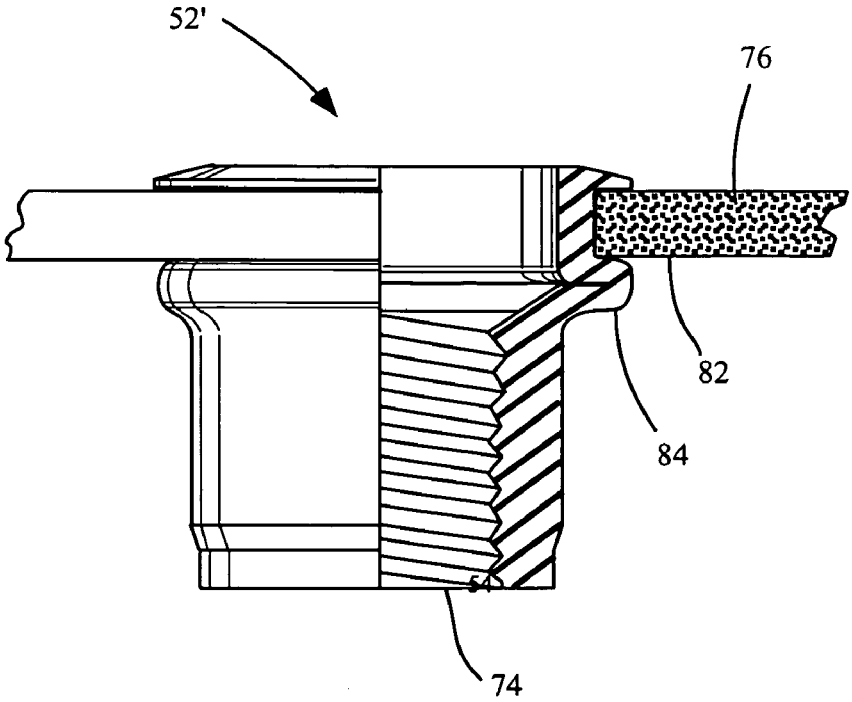
FIG. 22 shows a quarter-sectional view of the threaded insert of FIG. 21 after the insert has been installed in a work piece.

The disclosed apparatus is used in the same manner as known insert installation tools. An embodiment of a threaded insert which may be utilized with the disclosed apparatus is depicted in FIGS. 21 through 22. Threads 46 of mandrel 28 are made up into the threads 74 of the insert 52. The insert 52 is placed within an aperture in a work piece 76. As the mandrel 28 is withdrawn into housing 12 of the apparatus 10, the insert 52 is prevented from moving by the nose piece 16 engaging the face of flange 78. As the mandrel 28 is withdrawn further into housing 12, a portion of the tubular sleeve 80 of the insert 52 on the second side (or blind side) 82 of workpiece 76 is plastically deformed into a bubble 84 or secondary flange larger than the diameter of the hole in the workpiece. The bubble 84 prevents withdrawal of the insert 52' from the hole. FIG. 22 shows an insert 52' after it has been installed in workpiece 76 and the bubble 84 has been formed on the second side 82 of the workpiece.

These and other features, aspects, and advantages of the present invention will become better understood with regard to the following description, appended claims, and accompanying drawings. While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following claims.

What is claimed is:

1. A threaded insert installation apparatus comprising:

a housing comprising a body section and a nose piece, wherein the nose piece comprises a forward end and a rearward end, wherein the rearward end of the nose piece is attached to the body section;

a rotary power source contained within the housing;

reciprocating means contained within the housing;

a drive shaft comprising a first end and a second end opposite the first end, the drive shaft further comprising a circumferential shoulder member;

an extension member connecting the drive shaft to the rotary power source, wherein the first end of the drive shaft is received by the extension member;

a mandrel comprising a shaft, the mandrel further comprising a threaded end and a drive end opposite the threaded end, wherein a portion of the shaft comprises threads and the drive end is connected to the second end of the drive shaft wherein a portion of the mandrel is disposed in the nose piece with the threaded end extending beyond the forward end of the nose piece; and mandrel shock absorbing means for allowing the mandrel to reciprocate with respect to the nose piece from a first position to a second position, where the mandrel shock absorbing means operates independently from the reciprocating means.

2. The threaded insert installation apparatus of claim 1 wherein the mandrel shock absorbing means comprises a configuration of the extension member, the drive shaft, and the mandrel wherein the first end of the drive shaft may reciprocate with respect to the extension member from a first position to a second position and the mandrel may concurrently reciprocate with respect to the nose piece from a first position to a second position without the reciprocating means being activated, the mandrel shock absorbing means further comprising a first biasing means for maintaining the mandrel in the first position.

3. The threaded insert installation apparatus of claim 2 wherein the first biasing means comprises a first spring disposed circumferentially on the drive shaft, wherein a first end of the spring engages the extension member and a second end of the spring engages the circumferential shoulder member.

4. The threaded insert installation apparatus of claim 1 wherein the reciprocating means comprises a piston assembly contained within the housing, wherein the piston assembly comprises a piston body and a piston shaft axially connected to the piston body, wherein a first aperture extends axially through the piston body and piston shaft.

5. The threaded insert installation apparatus of claim 4 wherein the piston assembly is biased in a forward position toward the nose piece by a second biasing means.

6. The threaded insert installation apparatus of claim 5 wherein the second biasing means comprises a second spring disposed against the piston body.

7. The threaded insert installation apparatus of claim 6 wherein the piston assembly is reciprocated to a rearward position by the application of hydraulic force sufficient to overcome the bias of the second spring.

8. The threaded insert installation apparatus of claim 4 wherein a portion of the drive shaft is disposed within the first aperture.

9. The threaded insert installation apparatus of claim 4 further comprising a cover member having an open end and a closed end, wherein the open end of the cover member is axially attached to the piston shaft and the closed end of the cover member comprises an end plate having a second aperture.

10. The threaded insert installation apparatus of claim 9 wherein the cover member is disposed within the nose piece and a portion of the mandrel is disposed within the cover member and the shaft of the mandrel extends through the second aperture.

11. The threaded insert installation apparatus of claim 9 wherein the cover member comprises a hexagonal tube.

12. The threaded insert installation apparatus of claim 9 wherein the rearward end of the mandrel comprises a cylindrical member, wherein the cylindrical member has a diameter exceeding the diameter of the shaft of the mandrel and the diameter of the cylindrical member exceeds the diameter of the second aperture.

13. The threaded insert installation apparatus of claim 12 wherein the shaft extends through the second aperture and the cylindrical member is biased against the end plate of the cover member by the first spring.

14. The threaded insert installation apparatus of claim 13 wherein the cylindrical member may be reciprocated within the cover member from a first position biased against the end plate to a second position away from the end plate.

15. The threaded insert installation apparatus of claim 1 wherein the shaft has a chamfered tip.

16. A threaded insert installation apparatus comprising:

a housing comprising a body section and a nose piece, wherein the nose piece comprises a forward end and a rearward end, wherein the rearward end of the nose piece is attached to the body section;

a rotary power source contained within the housing;

reciprocating means contained within the housing;

a drive shaft comprising a first end and a second end opposite the first end, the drive shaft further comprising a circumferential shoulder member;

an extension member connecting the drive shaft to the rotary power source, wherein the first end of the drive shaft is received by the extension member;

a mandrel comprising a shaft, the mandrel further comprising a threaded end and a drive end opposite the threaded end, wherein a portion of the shaft comprises threads and the drive end is connected to the second end of the drive shaft wherein a portion of the mandrel is disposed in the nose piece with the threaded end extending beyond the forward end of the nose piece; and mandrel shock absorbing means comprising a configuration of the extension member, the drive shaft, and the mandrel wherein the first end of the drive shaft may reciprocate with respect to the extension member from a first position to a second position and the mandrel may concurrently reciprocate with respect to the nose piece from a first position to a second position without the reciprocating means being activated, the mandrel shock absorbing means further comprising a first spring disposed circumferentially on the drive shaft, wherein a first end of the spring engages the extension member and a second end of the spring engages the circumferential shoulder member thereby maintaining the mandrel in the first position.

17. The threaded insert installation apparatus of claim 16 wherein the reciprocating means comprises a piston assembly contained within the housing, wherein the piston assembly comprises a piston body and a piston shaft axially connected to the piston body, wherein a first aperture extends axially through the piston body and piston shaft and a portion of the drive shaft is disposed within the aperture.

18. The threaded insert installation apparatus of claim 17 wherein the piston assembly is biased in a forward position toward the nose piece by a second spring disposed against the piston body, wherein the piston assembly is reciprocated to a rearward position by the application of hydraulic force sufficient to overcome the bias of the second spring.

19. The threaded insert installation apparatus of claim 18 further comprising a cover member having an open end and a closed end, wherein the open end of the cover member is axially attached to the piston shaft and the closed end of the cover member comprises an end plate having a second aperture, wherein the cover member is disposed within the nose piece and a portion of the mandrel is disposed within the cover member, the shaft of the mandrel extending through the aperture of the end plate, where the drive end of the mandrel comprises a cylindrical member, wherein the cylindrical member has a diameter exceeding the diameter of the shaft of the mandrel and the diameter of the cylindrical member exceeds the diameter of the second aperture, wherein the shaft extends through the second aperture and the cylindrical member is biased against the end plate of the cover member by the first spring, wherein the cylindrical member may be reciprocated within the cover member from a first position biased against the end plate to a second position away from the end plate.

20. A threaded insert installation apparatus comprising:

a housing comprising a body section and a nose piece, wherein the nose piece comprises a forward end and a rearward end, wherein the rearward end of the nose piece is attached to the body section;

a rotary power source contained within the housing;

a drive shaft comprising a first end and a second end opposite the first end, the drive shaft further comprising a circumferential shoulder member;

reciprocating means contained within the housing, wherein the reciprocating means comprises a piston assembly contained within the housing, wherein the piston assembly comprises a piston body and a piston shaft axially connected to the piston body, wherein the piston assembly is biased in a forward position toward the nose piece by a second spring disposed against the piston body, wherein a first aperture extends axially through the piston body and through the piston shaft and a portion of the drive shaft is disposed within the first aperture, wherein the piston assembly is reciprocated to a rearward position by the application of hydraulic force sufficient to overcome the bias of the second spring;

an extension member connecting the drive shaft to the rotary power source, wherein the first end of the drive shaft is received by the extension member;

a mandrel comprising a shaft, the mandrel further comprising a threaded end and a drive end opposite the threaded end, wherein a portion of the shaft comprises threads and the drive end is connected to the second end of the drive shaft, wherein a portion of mandrel is disposed in the nose piece with the threaded end extending beyond the forward end of the nose piece;

mandrel shock absorbing means comprising a configuration of the extension member, the drive shaft, and the mandrel wherein the first end of the drive shaft may reciprocate with respect to the extension member from a first position to a second position and the mandrel may concurrently reciprocate with respect to the nose piece from a first position to a second position without the reciprocating means being activated, the mandrel shock absorbing means further comprising a first spring disposed circumferentially on the drive shaft, wherein a first end of the spring engages the extension member and a second end of the spring engages the circumferential shoulder member thereby maintaining the mandrel in the first position; and a cover member having an open end and a closed end, wherein the open end of the cover member is axially attached to the piston shaft and the closed end of the cover member comprises an end plate having a second aperture, wherein the cover member is disposed within the nose piece and a portion of the mandrel is disposed within the cover member, the shaft of the mandrel extending through the aperture of the end plate, wherein the drive end of the mandrel comprises a cylindrical member, wherein the cylindrical member has a diameter exceeding the diameter of the shaft of the mandrel and the diameter of the cylindrical member exceeds the diameter of the second aperture, wherein the shaft extends through the second aperture and the cylindrical member is biased against the end plate of the cover member by the first spring, wherein the cylindrical member may be reciprocated within the cover member from a first position biased against the end plate to a second position away from the end plate.

* * * * *